US010907315B2

(12) United States Patent
Foster et al.

(10) Patent No.: US 10,907,315 B2
(45) Date of Patent: Feb. 2, 2021

(54) PORTABLE TIRE RUPTURE DEVICE

(71) Applicant: Porta-Spike Industries, LLC, Lee's Summit, MO (US)

(72) Inventors: Stuart G. Foster, Lee's Summit, MO (US); Anthony C. Borrell, Waverly, MN (US)

(73) Assignee: Porta-Spike Industries, LLC, Lee's Summit, MO (US)

( * ) Notice: Subject to any disclaimer, the term of this patent is extended or adjusted under 35 U.S.C. 154(b) by 0 days.

(21) Appl. No.: 15/971,090

(22) Filed: May 4, 2018

(65) Prior Publication Data

US 2018/0320327 A1 Nov. 8, 2018

Related U.S. Application Data

(60) Provisional application No. 62/501,551, filed on May 4, 2017.

(51) Int. Cl.
*E01F 13/12* (2006.01)

(52) U.S. Cl.
CPC ..... *E01F 13/12* (2013.01)

(58) Field of Classification Search
CPC ..... E01F 13/12; B26B 1/02
USPC ..... 404/6; 30/429
See application file for complete search history.

(56) References Cited

U.S. PATENT DOCUMENTS 73,674 A * 1/1868 Timby ..... B26B 1/02 30/155
1,507,093 A * 9/1924 Schioniger ..... B67B 7/30 30/429
1,669,311 A * 5/1928 Strengberg ..... B67B 7/30 30/429
1,921,911 A * 8/1933 Darque ..... B67B 7/30 30/429
2,413,528 A * 12/1946 Speaker ..... 30/429
2,733,505 A * 2/1956 Kenington et al. ..... B67B 7/30 30/429
5,099,579 A * 3/1992 Chadwick ..... B26F 1/24 30/358
5,189,750 A * 3/1993 Brennan ..... B67B 7/16 7/152
5,588,774 A * 12/1996 Behan ..... E01F 13/123 404/6
6,312,189 B1 * 11/2001 Marphetia ..... E01F 13/12 404/6
6,409,418 B1 * 6/2002 Blair ..... E01F 13/123 404/6
6,749,362 B1 * 6/2004 Eichenberg ..... E01F 13/12 404/6
6,994,488 B2 * 2/2006 Crowley, Sr. ..... E01F 13/12 404/6
7,025,526 B2 * 4/2006 Blair ..... E01F 13/105 404/6

(Continued)

*Primary Examiner* — Thomas B Will
*Assistant Examiner* — Katherine J Chu
(74) *Attorney, Agent, or Firm* — Husch Blackwell LLP

(57) ABSTRACT

A tire rupture device that includes a blade attached to a base member that rests on a ground surface when used. Upon activating a lock mechanism of the rupture device, a blade may be revealed and exposed that may be placed in front of a tire of a vehicle so that if an operator of the vehicle attempts to drive off, the blade ruptures and rapidly deflates the tire, thus rendering the vehicle generally immobilized.

10 Claims, 10 Drawing Sheets

(56) References Cited

U.S. PATENT DOCUMENTS

| | | | | |
|---|---|---|---|---|
| 7,037,032 | B1 * | 5/2006 | Marphetia | E01F 13/12 404/6 |
| 7,162,803 | B2 * | 1/2007 | Lu | B23D 51/03 30/155 |
| 7,186,052 | B2 * | 3/2007 | Rom | B60R 25/09 404/6 |
| 7,641,417 | B2 * | 1/2010 | Barker | E01F 13/123 404/6 |
| 7,988,381 | B1 * | 8/2011 | Meyer-Pflug | F41H 11/08 404/6 |
| 8,087,173 | B2 * | 1/2012 | Tang | B25F 1/04 30/151 |
| 8,147,163 | B2 * | 4/2012 | Bare | E01F 13/12 404/6 |
| 9,815,212 | B2 * | 11/2017 | Barr | B26B 1/044 |
| 2005/0147466 | A1 * | 7/2005 | Crowley, Sr. | E01F 13/12 404/73 |
| 2005/0265781 | A1 * | 12/2005 | Blair | E01F 13/12 404/6 |
| 2008/0014017 | A1 * | 1/2008 | Liao | E01F 13/123 404/6 |
| 2009/0285629 | A1 * | 11/2009 | Dhondy | F41H 11/08 404/6 |
| 2010/0236077 | A1 * | 9/2010 | Shirey | B26B 27/007 30/152 |

* cited by examiner

PORTABLE TIRE RUPTURE DEVICE

CROSS-REFERENCE TO RELATED APPLICATIONS

This application claims the benefit of U.S. Provisional Application No. 62/501,551, filed May 4, 2017, which is hereby incorporated by reference in its entirety.

BACKGROUND OF THE INVENTION

Car chases often take place when a suspect operating a vehicle flees from law enforcement attempting to question, detain, or arrest a suspect. These often occur following a traffic stop in which the driver is suspected of committing a crime. The assumed offense committed may range from misdemeanors such as traffic violations to felonies as serious as murder. When the suspect realizes that they have been pulled over by law enforcement, and there is a real possibility that they are going to be arrested, they attempt to lose law enforcement by driving away, sometimes at high speeds.

These high speed chases often lead to injuries to the suspect, the law enforcement official or even innocent bystanders. In the United States, chase-related deaths range between 300 and 400 people per year and property damages exceeding 1 billion dollars per year.

Even moreover, property damage from the accused, law enforcement, or third party vehicle can take place when the vehicle strikes another vehicle, a business, or a home. Thus, there is a need for a device that can stop injury or death and property damage before it can happen. The device should be portable and compact enough to fit in a law enforcement official's or other user's vehicle so that it can be used during routine traffic stops. Further, police, SWAT, military personnel have a need for a device that may be used to stop suspects from fleeing when raiding homes, apartments, buildings and other structures by deploying a compact device under the tires of the suspects' vehicles prior to the raid. This compact device minimizes the chances of the suspects escaping, possibly with hostages or contraband.

SUMMARY OF INVENTION

The present invention in various forms provides a solution to both of the aforementioned problems. In one embodiment, the device includes a blade attached to a base member that has a handle extending upwards from the base member. When the device intended for traffic stops is in its compact form, the blade is concealed so that it does not injure a user. When the device is deployed, it may be placed in front of a tire of a suspect's vehicle (for example, a rear driver side tire). With the device deployed, the blade is in front of the vehicle's tire so that if the suspect attempts to drive off, the blade ruptures and rapidly deflates the tire so he or she is unable to do so.

In addition, other embodiments of the tire rupture device are provided that are smaller than the above-described embodiment. Those embodiments make the tire rupture device easier for a user to store and carry. This embodiment, which may be used in connection with police, SWAT, or military raids, makes it less likely that suspects will see it when they are approaching their vehicle to escape.

DETAILED DESCRIPTION OF THE INVENTION

Figure 1:
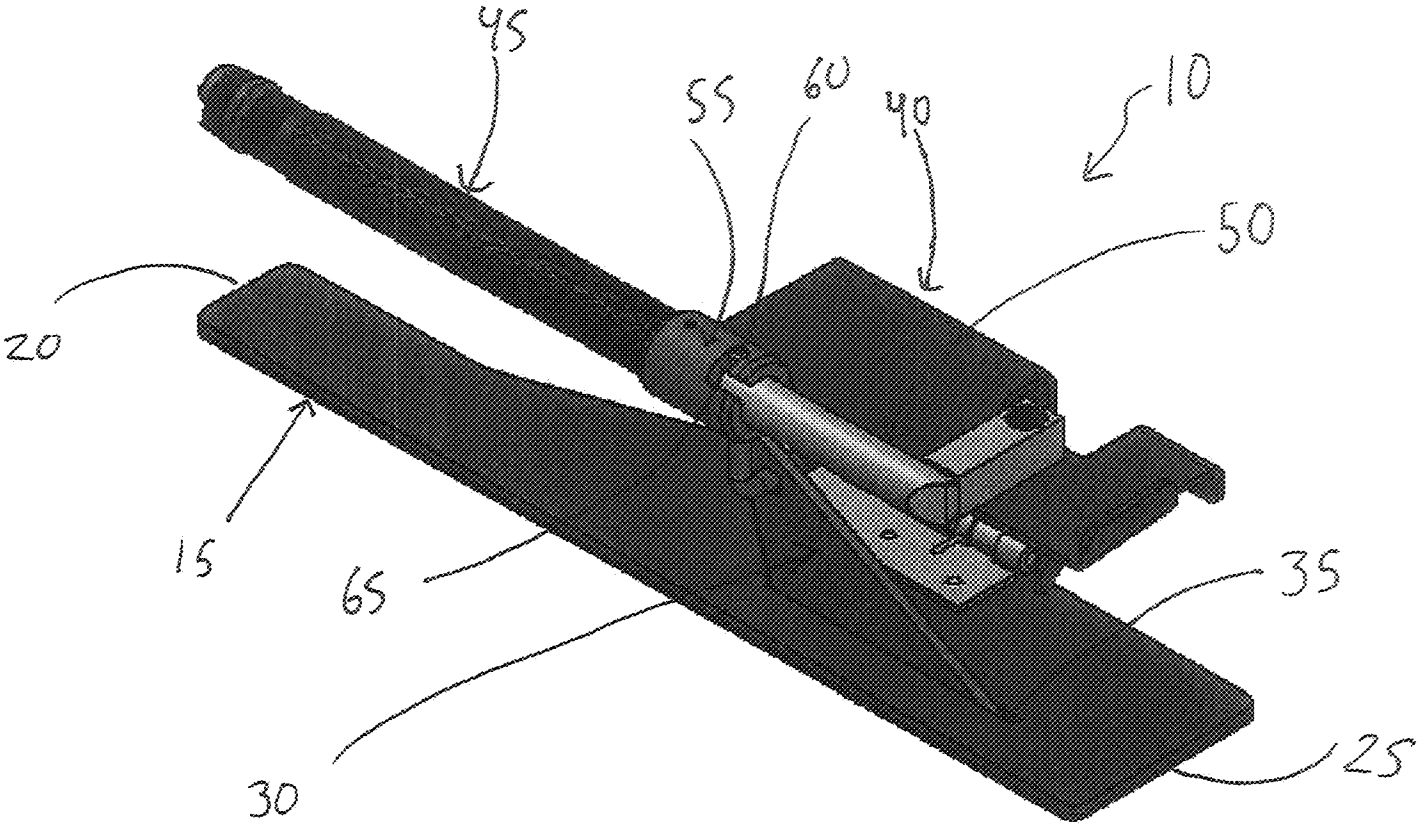
FIG. 1 is a perspective view of a portable tire rupture device, or rupture device, in its non-deployed configuration constructed according to the teachings of one embodiment of the present invention.
Figure 2:
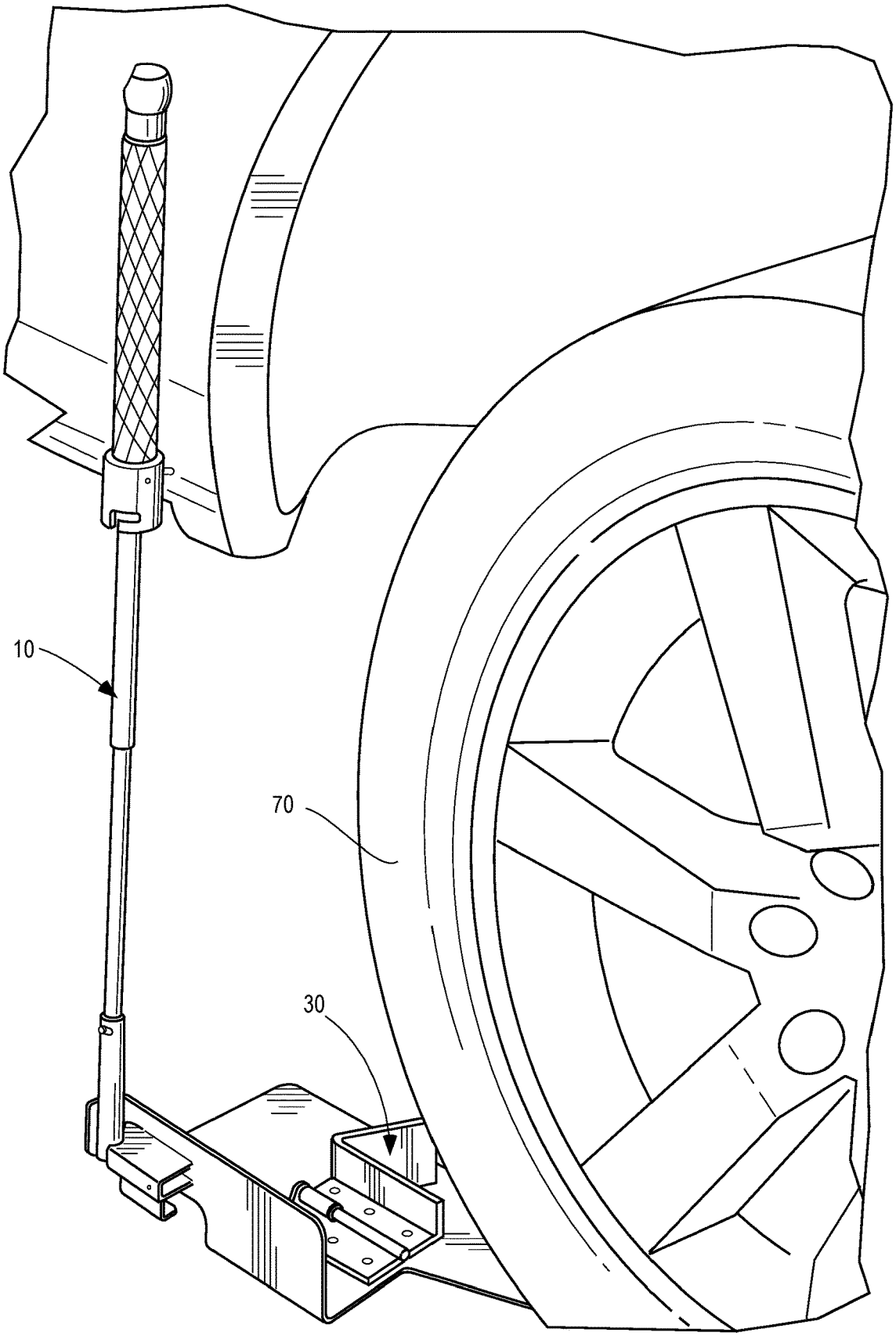
FIG. 2 is a perspective view of the rupture device of FIG. 1 in its deployed configuration and placed adjacent a vehicle's tires.

The present disclosure is directed to a portable tire rupture device for rapidly deflating tires. One embodiment of a portable tire rupture device 10 (hereinafter referred to simply as the "rupture device 10") is provided in FIG. 1. The rupture device 10 is shown in FIG. 1 in a non-deployed, compact form. This form may be useful to a user such as law enforcement professional or a member of the military when the rupture device 10 is stored or transported, for example in a vehicle or backpack. When deployed (as shown in FIG. 2 and described below), the rupture device 10 may be placed in front of a vehicle's tire. Preferably, the device 10 may be placed in front of a driver side rear tire since that is the first tire a law enforcement officer would pass if he were approaching the driver from the rear (as customarily done during a traffic stop). It will be appreciated that the rupture device 10 may be produced as a left-hand version (not shown) adapted for placement in front of the passenger side rear tire for those municipalities that require officers to approach a stopped vehicle from the passenger side. The left-hand version may also be used in countries having left-hand traffic regulations (i.e., where vehicles are driven on the left-hand side of the road), such as the United Kingdom. If the vehicle tries to drive away, the rupture device 10 may rapidly rupture a tire and thus deflate the tire so that the vehicle's driver is unable to flee the scene and injure themselves, other people, or damage property.

The rupture device 10 preferably includes a flat base member 15 that is made of a heavy metal such as steel. The base member 15 is substantially flat in shape and may be placed on a road or ground surface in front of a tire. The flat base member 15 includes each of a proximal end 20 and a distal end 25. The proximal end 20 of the base member 15 may be narrower than the distal end 25. This is primarily because the base member 15 is made from a heavy material such as steel, and reducing its width at the proximal end 20 may help to reduce the overall weight of the base member 15.

A blade 30 preferably made from a hardened steel may project upwardly from the base member 15. The blade 30 can include a base portion (not illustrated) below the base member 15. The blade 30 shown is preferably formed from the base portion so that is projects upwardly from the base portion. A slot 35 may receive the blade 30, and the blade 30 is inserted through the slot 35. The base portion of the blade 30 (having a substantial surface area) may abut the underside of the base member 15 to prevent the blade 30 from falling through the slot 35. It will be appreciated that the blade 30 may be permanently affixed to the base member 15, or may be attached thereto in a manner where it may be removed and/or replaced from time to time.

A lateral support member 40 also made from a steel may be hingedly attached to the base member 15. The lateral support member 40, when in an open or deployed position (as detailed below when describing FIG. 7) may have a first surface that substantially abuts the road or ground surface and a second surface that extends upwardly from the first surface. A handle 45 which is preferably able to be lengthened (as described below) is preferably rotatably attached to the second surface by a pivot handle member 50.

A locking mechanism 55 preferably releasably keeps the handle 45 engaged with the pivot handle member 50 until the rupture device 10 is ready to be deployed. The locking mechanism 55 may be made up of a projection member 60 projecting upwardly from the pivot handle member 50 and a slot 65 in a portion of the handle 45. The locking mechanism 55 and lateral support member 40, as described below, preferably conceals the blade 30 so that it does not potentially injure a person or damage property when not in use.

The manner in which the rupture device 10 is deployed is described in greater detail below. Nonetheless, FIG. 2 provides a photograph of what the rupture device 10 looks like when deployed in front of a tire 70. With the rupture device 10 deployed, the blade 30 is exposed in front of the tire 70. Were the car to accelerate with the rupture device 10 deployed in front of the tire 70, the tire 70 would run over the blade 30. The blade 30 would preferably puncture the tire 70, and soon after deflate the tire 70 so that a driver is unable to drive away.

Figure 3:
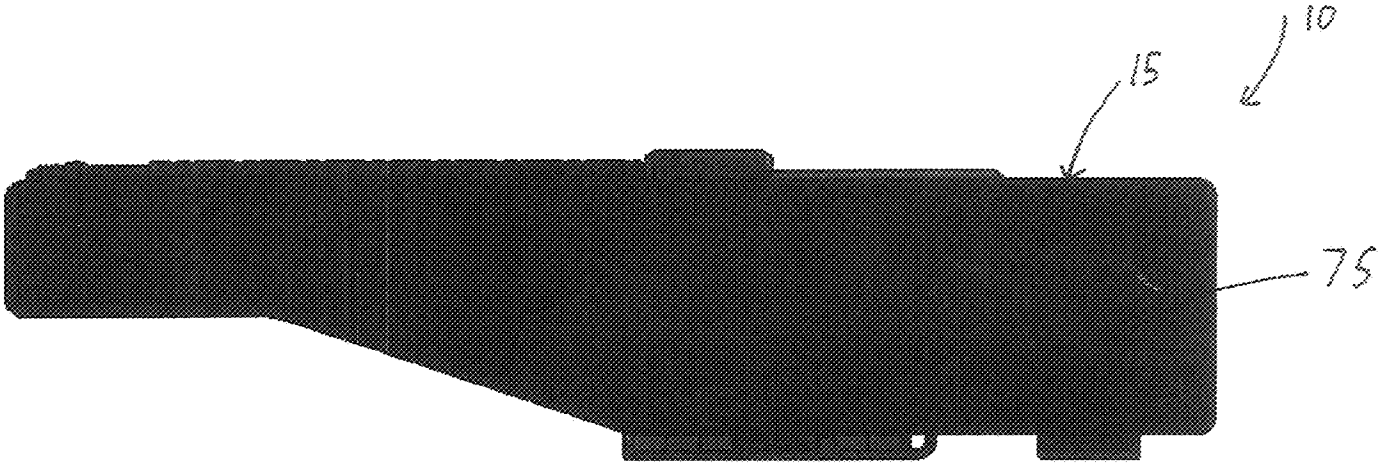
FIG. 3 is a bottom plan view of the rupture device of FIGS. 1 and 2 in its non-deployed configuration.
Figure 4:
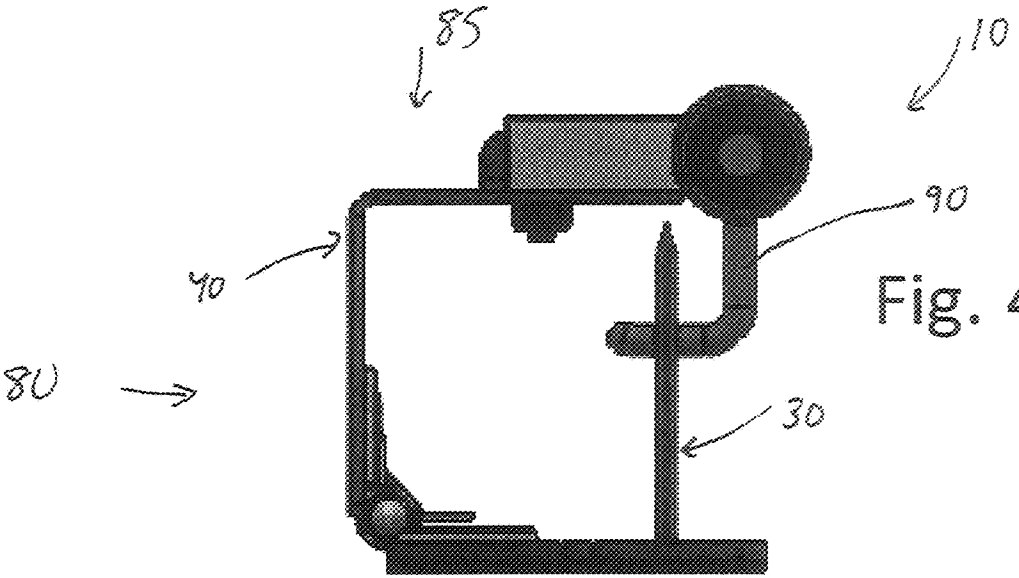
FIG. 4 is a rear elevation view of the rupture device of FIGS. 1-3 in its non-deployed configuration.
Figure 5:
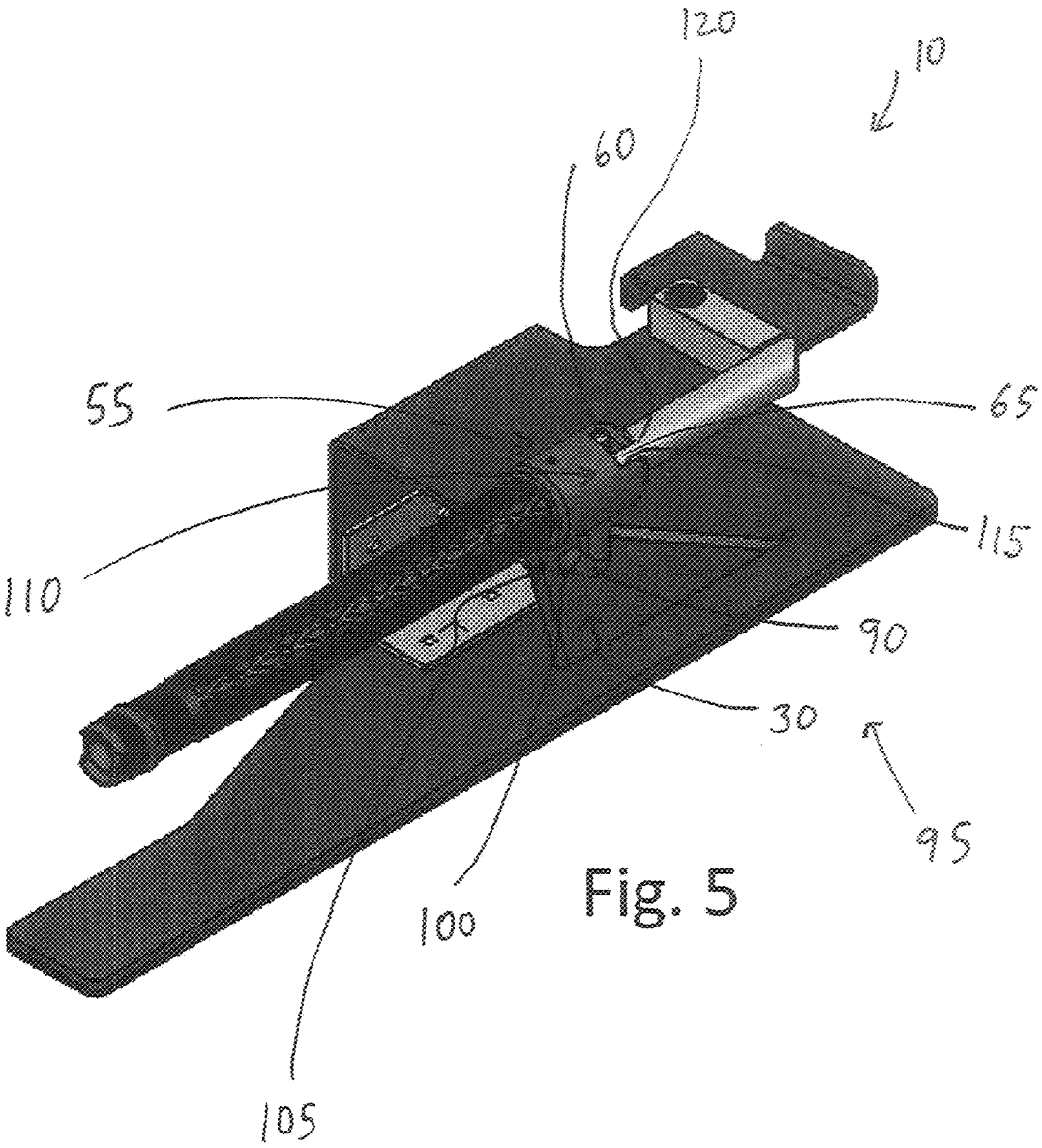
FIG. 5 is a second perspective view of the rupture device of FIGS. 1-4 in its non-displayed configuration.

FIGS. 3-5 illustrate various views of the rupture device 10 in its non-deployed configuration. In FIG. 3, a bottom surface 75 of the base member 15 is shown. The bottom surface 75 preferably covers the entire underside of the base member 15. In a preferred embodiment, the bottom surface 75 is made up of a black rubber. The bottom surface 75 is preferably made of a rubberized substance such that when a car and its tire, such as the tire 70, drive over the rupture device 10, the bottom surface 75 (and thus the entire base member 15) remains in place. If the bottom surface 75 of the base member 15 were made of a substance having less grip ability than the rubber surface, a car may simply push the rupture device 10 forward, rather than drive over it, or may, upon driving over the rupture device 10, propel it rearwardly thereby turning it into an unsafe projectile. In alternative embodiments, materials other than a rubber may be used to coat the bottom surface 75 of the base member 15, so long as it has some traction properties.

Turning now to FIG. 4, a rear elevation view of the rupture device 10 is provided. As shown in FIG. 4, when the rupture device is in its non-deployed configuration, the blade 30 may be protected by various structures of the device 10 to conceal the blade 30 (and thus also reduce the likelihood of harm). The lateral support member 40 can cover both an internal side 80 of the rupture device 10 and an upper side 85 of the rupture device 10. That way, the blade 30 cannot be accessed from either of the internal side 80 or the upper side 85.

With the locking mechanism 55 in its engaged position (as shown in FIG. 1 and described in greater detail when describing FIG. 5), a hook member 90 extending downwardly from the locking mechanism 55 is preferably received and engaged at an external side 95 of the rupture device 10. More particularly, as shown in FIG. 5, the hook member 90 is received and engaged within an aperture 100 of the blade 30 at an upper portion 105 of the blade 30. The hook member 90 may be formed from a collar 110 that is generally cylindrical. The cylindrical collar 110 can also include the slot 65 in which the projection 60 of the pivot handle member 40 is releasably engaged. The collar 110 may have a circumference only slightly greater than the handle 45 or the pivot handle member 50. Thus, the collar 110 is preferably able to snugly and securely fit around the handle 45 toward the proximal end 20 of the base member 15. The collar 110 is preferably firmly attached to the handle 45 so that when the handle 45 is moved, so too is the collar 110.

The collar 110 also may snugly fit around the pivot handle member 50 toward the distal end 25 of the base member 15. However, the connection between the collar 110 and the pivot handle member 50 is not an "attachment-like" connection. In other words, the collar 110 is able to slide over the pivot handle member 50 as a "friction fit."

Figure 6:
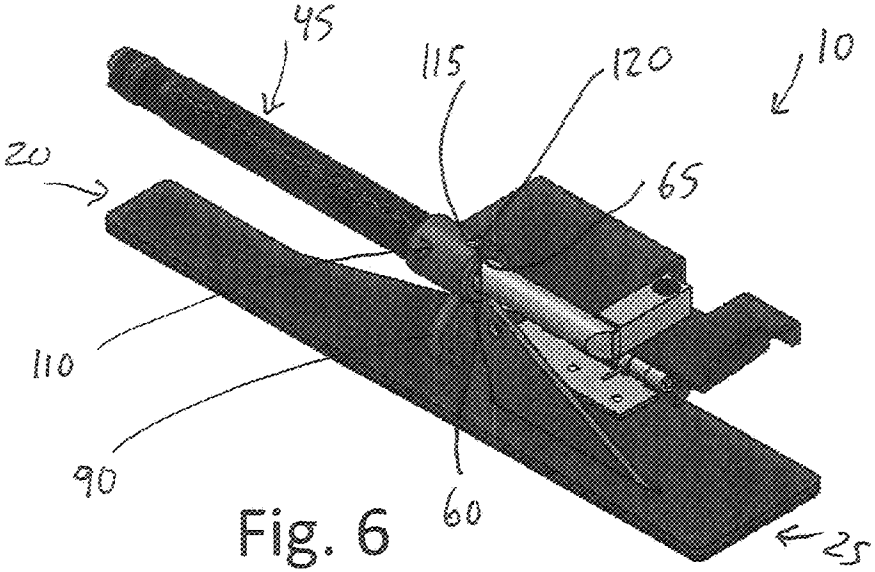
FIG. 6 is a perspective view of the rupture device of FIGS. 1-5 illustrating its handle in in rotated position and having a safety hook of the rupture device in a disengaged position.

In order to deploy the rupture device 10, the projection member 60 should first be removed from the slot 65. The projection member 60 may be disengaged from the slot 65 by first rotating the handle 45 in a clockwise direction such that the projection member 60 slides in the slot 65 until it abuts an interior portion 115 of the collar 110. The interior portion 115 is shown in each of FIGS. 5 and 6. When the handle member 45 is rotated in a clockwise direction, the hook member 90 is similarly rotated in a clockwise direction such that it disengages from the aperture 100 of the blade 30, as shown in FIG. 6.

Next, the handle member 45 may be pulled toward the proximal end 20 of the rupture device 10, thus pulling the collar 110 also toward the proximal end 20 of the rupture device 10. As this occurs, the projection member 60 maybe dislodged from a longitudinal portion 120 of the slot 60 so that the handle 45 and in the collar 110 are no longer engaged with the handle pivot member 50.

Figure 7:
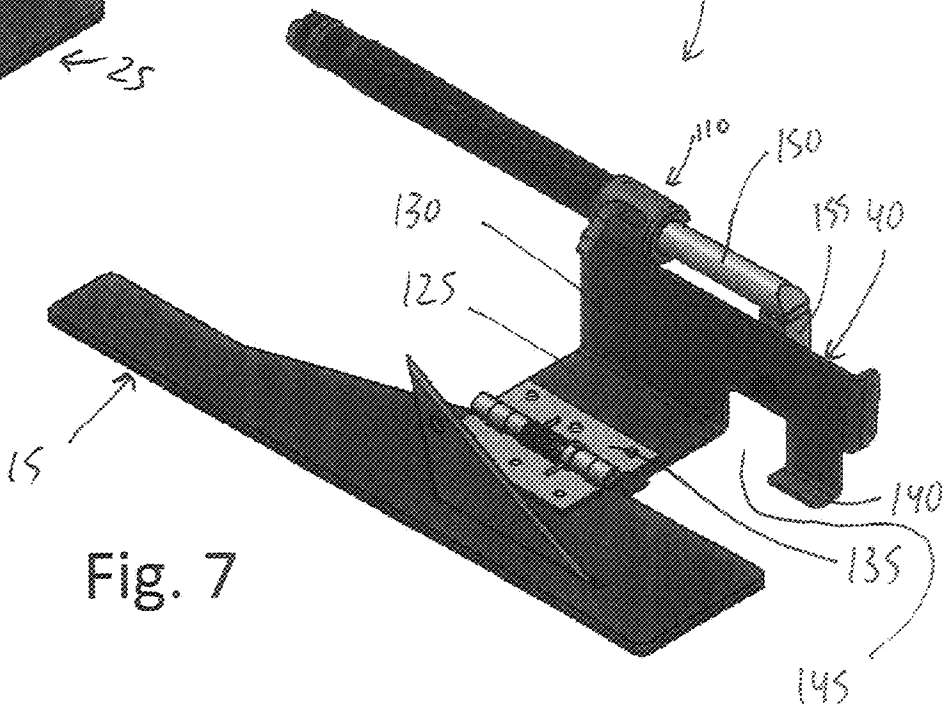
FIG. 7 is a perspective view of the rupture device of FIGS. 1-6 with a lateral support member of the rupture device illustrated in a deployed position.

With the handle member 45 and the collar 110 disengaged from the projection member 60, the handle member 45, attached to the lateral support member 40 of the handle member pivot member 50, may be pushed outwardly so that a first surface 125 of the lateral support member 40 is substantial parallel and adjacent to the base member 15, as shown in FIG. 7. Also, a second surface 130 of the lateral support member 40 may be substantially perpendicular to the base member 15 and to the second surface 125 of the lateral support member 40.

The lateral support member 40 is able to rotate outwardly from its first surface 125 because a hinge member 135 is preferably used to attach the base member 15 to the first surface 125 of the lateral support member 40. In a preferred embodiment, the hinge member 135 may be spring loaded. Thus, when the handle 45 and the collar 110 are disengaged from the projection member 60, the hinge member 135 may utilize its spring loaded mechanism to automatically cause the rupture device 10 to take the configuration illustrated in FIG. 7. In the form illustrated in FIG. 7, the base member 15 and the first surface 125 of the lateral support member 40 are substantially adjacent to the ground surface. In some embodiments an underside of the first surface 125 "not illustrated" may also be coated in rubber to allow for even more traction against the ground surface.

In addition to the first surface 125 that is parallel and adjacent to the base member 15, a tab or third surface 140 may also be provided that is parallel to the base member 15 and the first surface 125. The third surface 140 also is preferably substantially adjacent to the ground surface. As such, its underside (not illustrated) may also be made of a rubber or other substance that helps the underside of the third surface 140 to grip the ground surface. The third surface 140 is separated from the first surface 125 by a void or cut-out portion 145 that has been subtracted from the second surface 130. The cut-out portion 145 may help to reduce the total weight of the rupture device 10. In alternative embodiments, there may not be such a cut-out portion 145. In any event, the second surface 140 helps to maintain the balance of the lateral support member 40 and the rupture device 10 more completely when the lateral support member is deployed in the manner shown FIG. 7.

As shown in FIG. 7, the pivot handle member 50 may actually be comprised of two separate parts. A first portion 150 extends from the collar 110. The first portion 150 is preferably hingedly attached to a second portion 155 that is substantially perpendicular to the first portion 150 when the handle member 45 has not yet been rotated toward the distal end 25 of the base member 15, as shown in FIG. 8.

Figure 8:
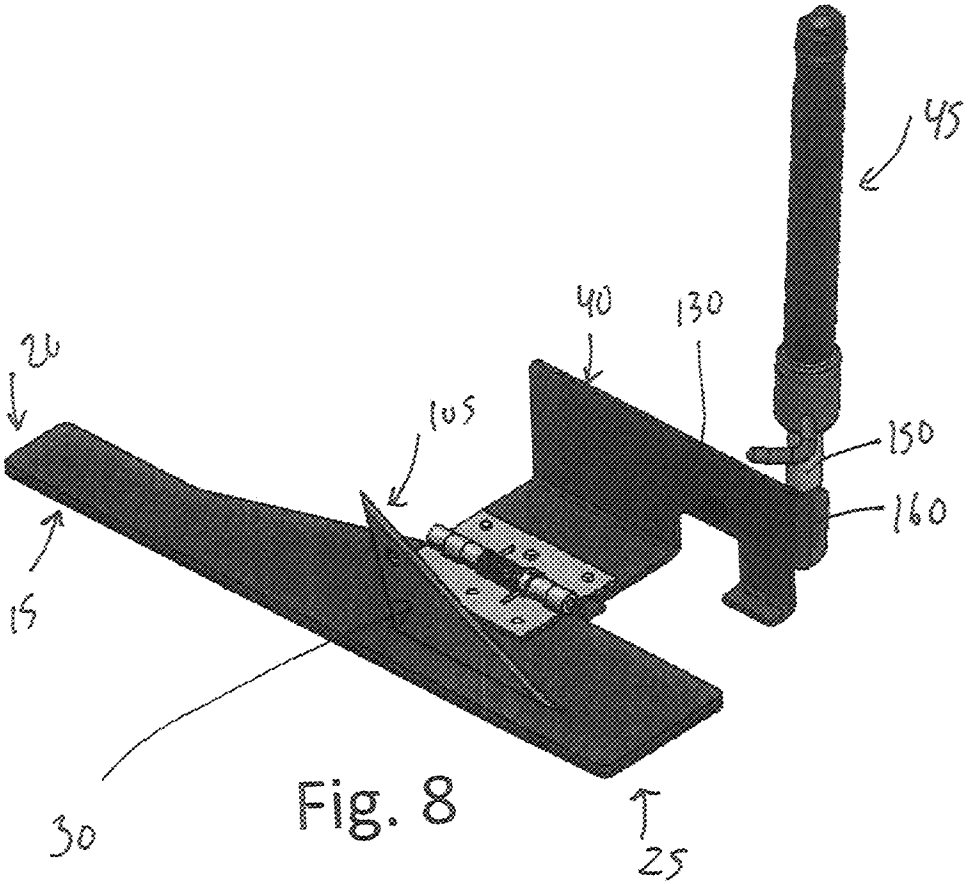
FIG. 8 is a perspective view of the rupture device of FIGS. 1-7 with a handle member of the rupture device rotated upwardly.

In FIG. 8, the handle 45 has been rotated toward the distal end 25 of the base member 15 by rotating the handle member 45 about the hinged attachment between the first and second portions 150, 155. A stop member 160 may be provided that projects outwardly from the second surface 130 of the lateral support member 40. The stop member 160 helps to prevent the first portion 150 of the pivot handle member 50 from extending or rotating too far toward the distal portion 25 of the base member 15 and thus causing the rupture device 10 to become unstable. In FIG. 8, the first portion 150 is shown abutting the stop member 160.

FIG. 8 further illustrates the shape of the blade 30. In a preferred embodiment, the blade 30 comes to a point at its upper portion 105. As such, as shown, it is substantially triangular in shape. The blade 30 preferably has a triangular shape coming to a point at its upper portion 105 because the point at the upper portion 105 is preferably best able to quickly and effectively puncture a tire. The angle between the upper portion 105 of the blade 30 and the base member toward its proximal portion 25 is approximately 30° in one embodiment, though it could take on other angles in alternative embodiments. At this angle, the upper portion 105 may be essentially "pointing at" an approaching tire such as tire 70.

In yet other embodiments multiple blades or spikes taking on numerous different shapes may be present instead of the blade 30. In those embodiments, the blades or spikes would similarly be attached or otherwise coupled to the base member 15. It should also be noted that with the lateral support member 40 deployed in the manner shown in FIG. 8, the base member 15 and its length is better shown.

As previously mentioned, when the rupture device 10 is in use, it should be placed such that the proximal portion 20 of the base member is nearest the tire 70. The distance from the proximal portion 20 of the base member 15 to the blade member 30 is preferably approximately two-thirds of the total length of the base member 15. This distance, which may be adjusted with experimentation, is preferably sufficient that the tire is able to completely drive onto the portion of the base member 15 between the proximal portion 20 and blade member 30 so that the weight of the vehicle is on the base member 15 before a tire would drive over the blade 30. The weight of the tire helps to prevent the vehicle from simply pushing the rupture device 10 rather than driving over its blade 30. This distance between the proximal end 20 and the blade member 30 can also ensure that the rupture device 10 is placed in a position such that the point 105 of the blade member 30 does not inadvertently engage or puncture the tire.

Figure 9:
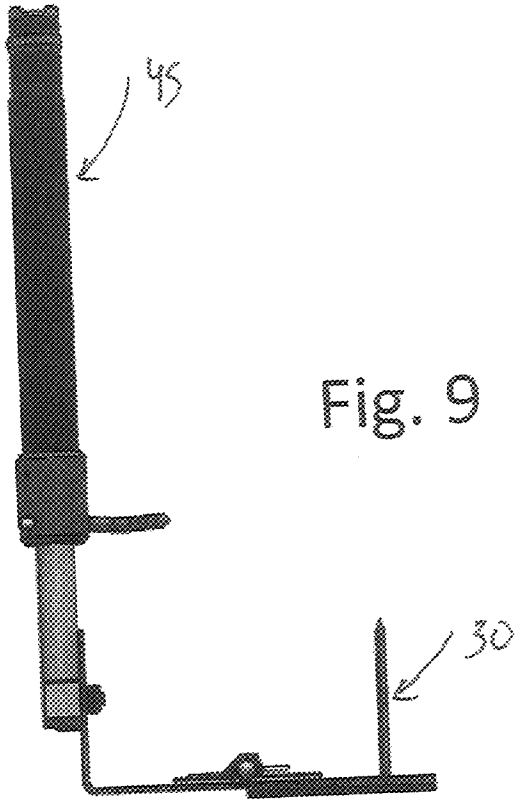
FIG. 9 is a rear elevation view of the rupture device of FIGS. 1-8 with the handle member support member of the rupture device rotated upwardly.

In some embodiments, the blade 30 may be lubricated by a coating, such as a silicone or Teflon coating, for example. Such lubrication may help the blade member 30 to more quickly and efficiently rupture a tire when it drives over the blade 30. FIG. 9 shows the blade 30 exposed with the handle member 45 prepared to be upwardly extended.

Figure 10:
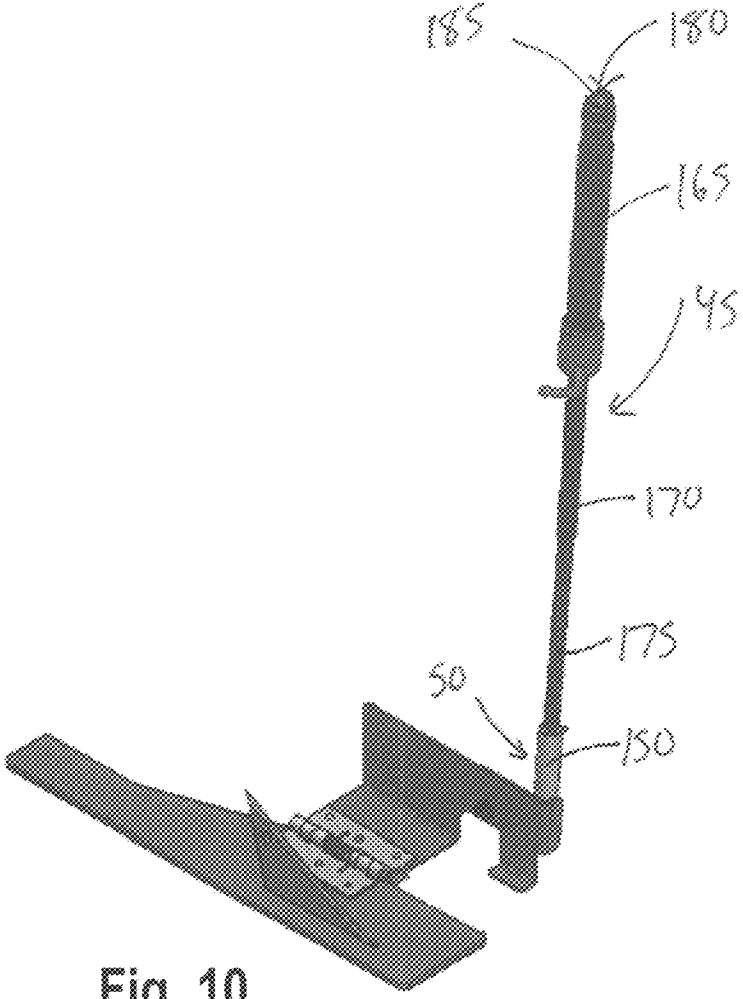
FIG. 10 is a perspective view of the rupture device of FIGS. 1-9 with the handle member of the rupture device deployed in an extended position.

Turning now to FIG. 10, it is apparent that the handle 45 is actually comprised of several parts. The handle 45 may be a telescoping handle. Thus, as shown in FIG. 10, the handle 45 may include each of an upper section 165, a middle section 170, and a lower section 175. Each of the lower, middle, and upper sections 175, 170, 165 may be upwardly extended from the first section 150 of the pivot handle member 50. In one embodiment an interior (not illustrated) of the upper section 165 is just larger than the circumference of the middle section 170, which has an interior portion (not illustrated) just larger that the circumference of the lower section 175. Stop members located within the interior portions of the upper, middle, and lower sections 165, 170, and 175 may keep the respective sections attached to one another. When the handle 45 is fully telescoped as shown in FIG. 10, a top portion 180 of the handle member 45 may be approximately 3 to 5 feet above the ground.

The top portion 180 of the handle member may further include a safety light 185. This safety light 185 may be an LED or other light such as a red strobe light so that drivers passing by are able to see and avoid the deployed rupture device 10. The safety light 185 also may help a law enforcement official to remember to take the rupture device 10 with him or her when he or she returns to his or her car after a traffic stop (in which the suspect does not flee the scene).

In order to re-collapse the rupture device 10, a user should take the reverse steps described above to deploy the rupture device 10. Namely, he or she should push the handle 45 downwardly to collapse the handle 45 toward the first surface 150 of the pivot handle member 50. Next he or she should rotate the lateral support member 40 toward the blade 30. Finally, he or she should insert the hook 90 into the aperture 100 of the blade 30 by rotating the handle 45 to lock the handle 45 into place and conceal the blade 30.

Figure 11:
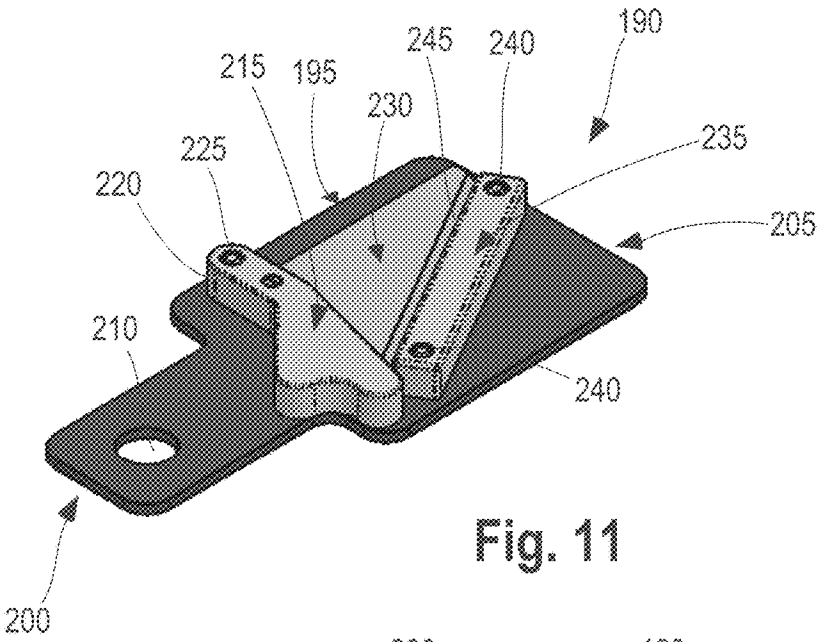
FIG. 11 is a perspective view of a first alternative embodiment of a compact portable tire rupture device, or compact rupture device, in its non-deployed configuration constructed according to the teachings of one embodiment of the present invention.

A second embodiment of a portable tire rupture device is provided in FIGS. 11 through 14. A compact rupture device 190 is shown in FIG. 11 in its non-deployed, compact configuration. In this configuration, the rupture device 190 may be stored in a user's vehicle or backpack or the like. When deployed in the manner described below, the rupture device 190 may be placed in front of a vehicle's tire, such as the tire 70, so that if a suspect tries to flee an officer, the rupture device 190 is able to quickly and effectively rupture the tire to prevent the suspect from fleeing the scene. The rupture device 190 is designed to be more compact that the rupture device 10. As such, the rupture device 190 only comprises a few simple parts.

The rupture device 190 can include a flat base member 195 that may be made of heavy metal such as steel, like the flat base member 15. In order to reduce the weight of the base member 195, a proximal portion 200 of the base member may be narrower than a distal portion 205 of the base member 195. As above, in a preferred embodiment, the proximal portion 200 is the portion of the rupture device 190 that is placed in front of a tire such as the tire 70 when the rupture device 190 is deployed.

Moreover, an aperture 210 may be provided near the proximal portion of the rupture device 195. The aperture 210 is preferably provided to help a law enforcement officer or other user to carry the rupture device 190.

A lock member 215 may also be provided above the base member 195. The lock member 215 may be pivotally attached to the base member 195 at a pivot point 220. The lock member 215 is preferably attached to the base member 195 using a bolt 225 as known and understood in the art. The lock member 215 preferably helps to keep the blade 230 in its collapsed position until the user is ready to deploy the rupture device 190. In at least one embodiment, an interior (not illustrated) of the lock member 215 may be recessed so as to receive and retain a portion of the blade 230. In that embodiment, when the lock member 215 is released from the blade 230 (as described below), the blade 230 may be able to deploy.

A guard member 235 is also preferably fixedly attached to the base member 195. In one embodiment, the guard member 235 is attached to the base member 195 using bolts 240. The guard member 235 may be attached to the base member 195 at a specific location adjacent a first elongated exterior portion 245 of the blade 230. As such, when the rupture device 190 is in its non-deployed form shown and illustrated in FIG. 11, the blade 230 is fully enclosed by the lock member 215 and the guard member 235. In one embodiment, and as shown in FIG. 11, the lock member 215 and the guard member 235 abut one another when the blade 230 is in its non-deployed position.

Figure 12:
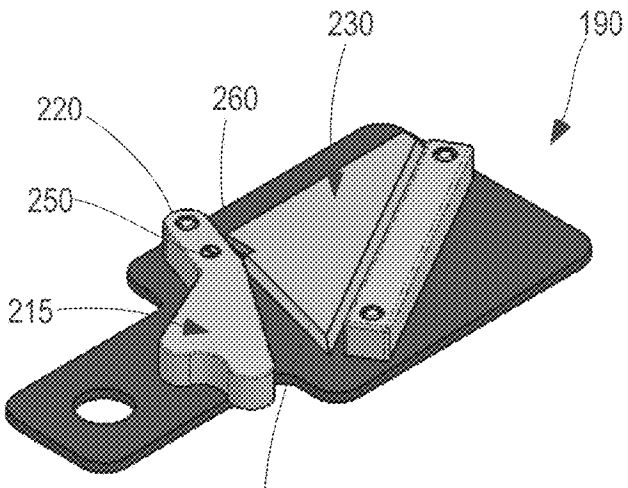
FIG. 12 is a perspective view of the compact rupture device of FIG. 11 with a guard member of the compact rupture device in its open position.
Figure 14:
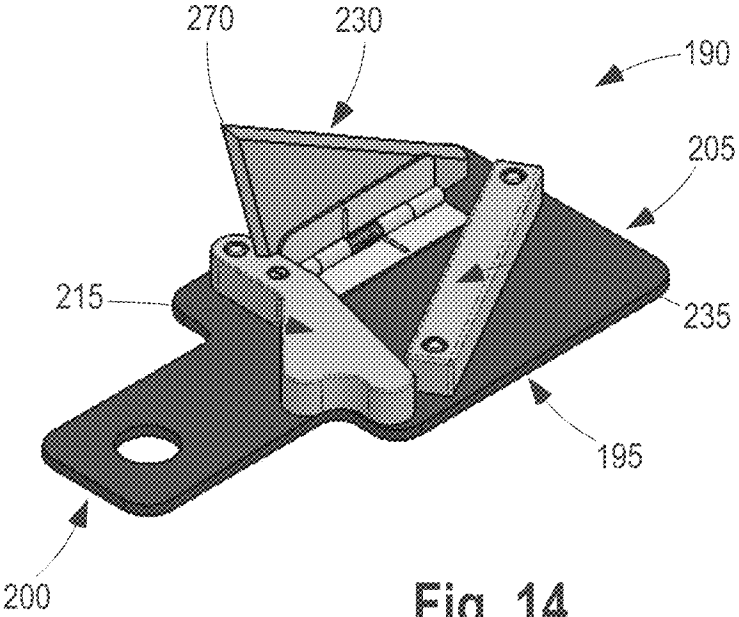
FIG. 14 is a perspective view of the compact rupture device of FIGS. 11-13 with the guard member of the compact rupture device retaining the blade in its upright position.

When a user is ready to deploy the blade 230, he or she may first activate a detent 250 that works in a manner to release the lock member 215 from a second exterior portion 255 of the blade member 230. The lock member 215 released from the blade member 230 is shown and illustrated in FIG. 12. Also shown in FIG. 12 is a cut-out portion 260 of the blade member 230. As shown and illustrated in FIG. 12, the cut-out portion 260 is shaped so that when the blade 230 is deployed (as shown in FIGS. 13 and 14), the cut-out portion 260 preferably substantially abuts and is received by the lock member 215 near its pivot point 220.

Figure 13:
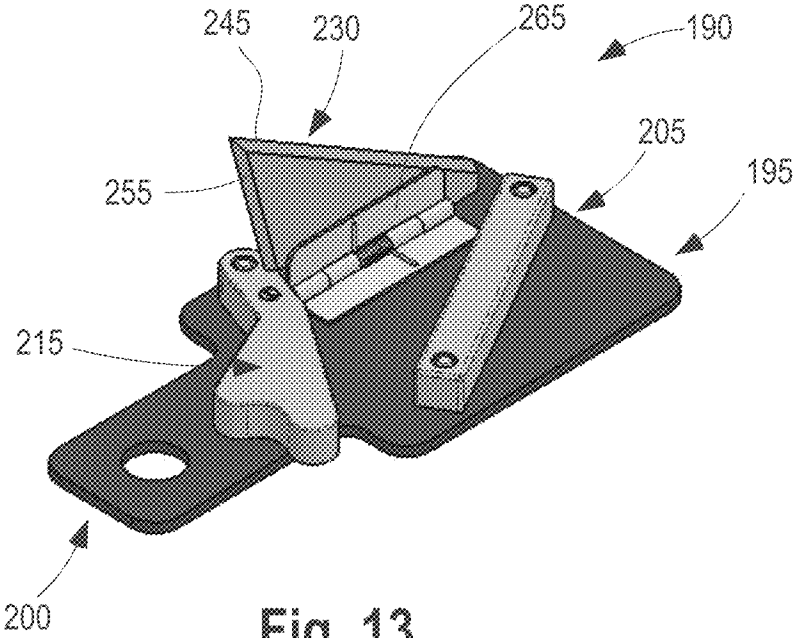
FIG. 13 is a perspective view of the compact rupture device of FIGS. 11 and 12 with a blade of the compact rupture device in its upright position.

Turning now to FIG. 13, the blade member 230 can be attached to the base member 195 by a spring loaded hinge member 265. Thus, when the detent 250 is activated and the lock member 215 is rotated away from the blade member 230, the blade member 230 is able to spring to its upright position illustrated in FIG. 13. With the blade member 230 in its upright position both the first exterior portion 245 and its second interior portion 255 of the blade member 230 are exposed.

To further reinforce the blade member 230 in its upright position, the lock member 215 may be rotated back toward the distal portion 205 of the base member 195. When the lock member 215 is rotated toward the distal portion 205 it may again abut the guard member 235. Because the cut-out portion 260 (not illustrated) is abutting the lock member 215 near its pivot point 220, the blade member 230 is preferably unable to collapse with the lock member 215 returned to its original position. As such, the rupture device 190 is ready to be placed in front of a tire such as tire 70. Because the blade member 230 is reinforced by each of the lock member 215 and the guard member 235, when a vehicle tire such as the tire 70 runs over the blade member 230, the blade member 230 is able to quickly and efficiently rupture the tire. The blade member 230 may be substantially sized and shaped, as well as made of hardened steel, like the blade member 30. Moreover, a tip 270 at the top of the blade member 230 may be oriented such that it is angled approximately 30 degrees relative to the base member 195. That way when a vehicles tire approaches the tip 270, the tip 270 is essentially aimed at the tire and is able to quickly and rapidly puncture the tire.

In order to collapse the blade member 230, the reverse steps of deploying the blade member 230 should be taken. More specially, the detent 250 should be activated to pull the lock member 215 toward the proximal portion 200 of the base member 195. At this time, the blade member 230 may be collapsed and the lock member 215 may be returned to its original position to retain the blade 230 in its non-deployed position shown in FIG. 11.

A second embodiment of a portable tire rupture is provided in FIGS. 11 through 14. A compact rupture device 190 is shown in FIG. 11 in its non-deployed, compact configuration. In this configuration, the rupture device 190 may be stored in a user's vehicle or backpack or the like. When deployed in the manner described below, the rupture device 190 may be placed in front of a vehicle's tire, such as the tire 70, so that if a suspect tries to flee an officer, the rupture device 190 is able to quickly and effectively rupture the tire to prevent the suspect from fleeing the scene. The rupture device 190 is designed to be more compact that the rupture device 10. As such, the rupture device 190 only comprises a few simple parts.

The rupture device 190 can include a flat base member 195 that may be made of heavy metal such as steel, like the flat base member 15. In order to reduce the weight of the base member 195, a proximal portion 200 of the base member may be narrower than a distal portion 205 of the base member 195. As above, in a preferred embodiment, the proximal portion 200 is the portion of the rupture device 190 that is placed in front of a tire such as the tire 70 when the rupture device 190 is deployed.

Moreover, an aperture 210 may be provided near the proximal portion of the rupture device 195. The aperture 210 is preferably provided to help a law enforcement officer or other user to carry the rupture device 190.

A lock member 215 may also be provided above the base member 195. The lock member 215 may be pivotally attached to the base member 195 at a pivot point 220. The lock member 215 is preferably attached to the base member 195 using a bolt 225 as known and understood in the art. The lock member 215 preferably helps to keep a blade 230 in its collapsed position until the user is ready to deploy the rupture device 190. In at least one embodiment, an interior (not illustrated) of the lock member 215 may be recessed so as to receive and retain a portion of the blade 230. In that embodiment, when the lock member 215 is released from the blade 230 (as described below), the blade 230 may be able to deploy.

A guard member 235 is also preferably fixedly attached to the base member 195. In one embodiment, the guard member 235 is attached to the base member 195 using bolts 240. The guard member 235 may be attached to the base member 195 at a specific location adjacent a first elongated exterior portion 245 of the blade 230. As such, when the rupture device 190 is in its non-deployed form shown and illustrated in FIG. 11, the blade 230 is fully enclosed by the lock member 215 and the guard member 235. In one embodiment, and as shown in FIG. 11, the lock member 215 and the guard member 235 abut one another when the blade 230 is in its non-deployed position.

When a user is ready to deploy the blade 230, he or she may first activate a detent 250, which works in a manner to release the lock member 215 from a second exterior portion 255 of the blade member 230. The lock member 215 released from the blade member 230 is shown and illustrated in FIG. 12. Also shown in FIG. 12 is a cut-out portion 260 of the blade member 230. As shown and illustrated in FIG. 12, the cut-out portion 260 is shaped so that when the blade 230 is deployed (as shown in FIGS. 13 and 14), the cut-out portion 260 preferably substantially abuts and is received by the lock member 215 near its pivot point 220.

Turning now to FIG. 13, the blade member 230 can be attached to the base member 195 by a spring loaded hinge member 265. Thus, when the detent 250 is activated and the lock member 215 is rotated away from the blade member 230, the blade member 230 is able to spring to its upright position illustrated in FIG. 13. With the blade member 230 in its upright position both the first exterior portion 245 and its second interior portion 255 of the blade member 230 are exposed.

To further reinforce the blade member 230 in its upright position, the lock member 215 may be rotated back toward the distal portion 205 of the base member 195. When the lock member 215 is rotated toward the distal portion 205, it may again abut the guard member 235. Because the cut-out portion 260 (not illustrated) is abutting the guard member 215 near its pivot point 220, the blade member 230 is preferably unable to collapse with the guard member 215 returned to its original position. As such, the rupture device 190 is ready to be placed in front of a tire such as tire 70. Because the blade member 230 is reinforced by each of the lock member 215 and the guard member 235, when a vehicle tire such as the tire 70 runs over the blade member 230, the blade member 230 is able to quickly and efficiently rupture the tire. The blade member 230 may be substantially sized and shaped, as well as made of hardened steel, like the blade member 30. Moreover, a tip 270 at the top of the blade member 230 may be oriented such that it is angled approximately 30 degrees relative to the base member 195. That way when a vehicles tire approaches the tip 270, the tip 270 is essentially aimed at the tire and is able to quickly and rapidly puncture the tire. Of course, it will be appreciated that the tip 270 and/or blade member 230 may be oriented at other angles that are more or less than 30 degrees relative to the base member 195.

In order to collapse the blade member 230, the reverse steps of deploying the blade member 230 should be taken. More specially, the detent 250 should be activated to pull the lock member 215 toward the proximal portion 200 of the base member 195. At this time, the blade member 230 may be collapsed and the lock member 215 may be returned to its original position to retain the blade 230 in its non-deployed position shown in FIG. 11.

Figure 15:
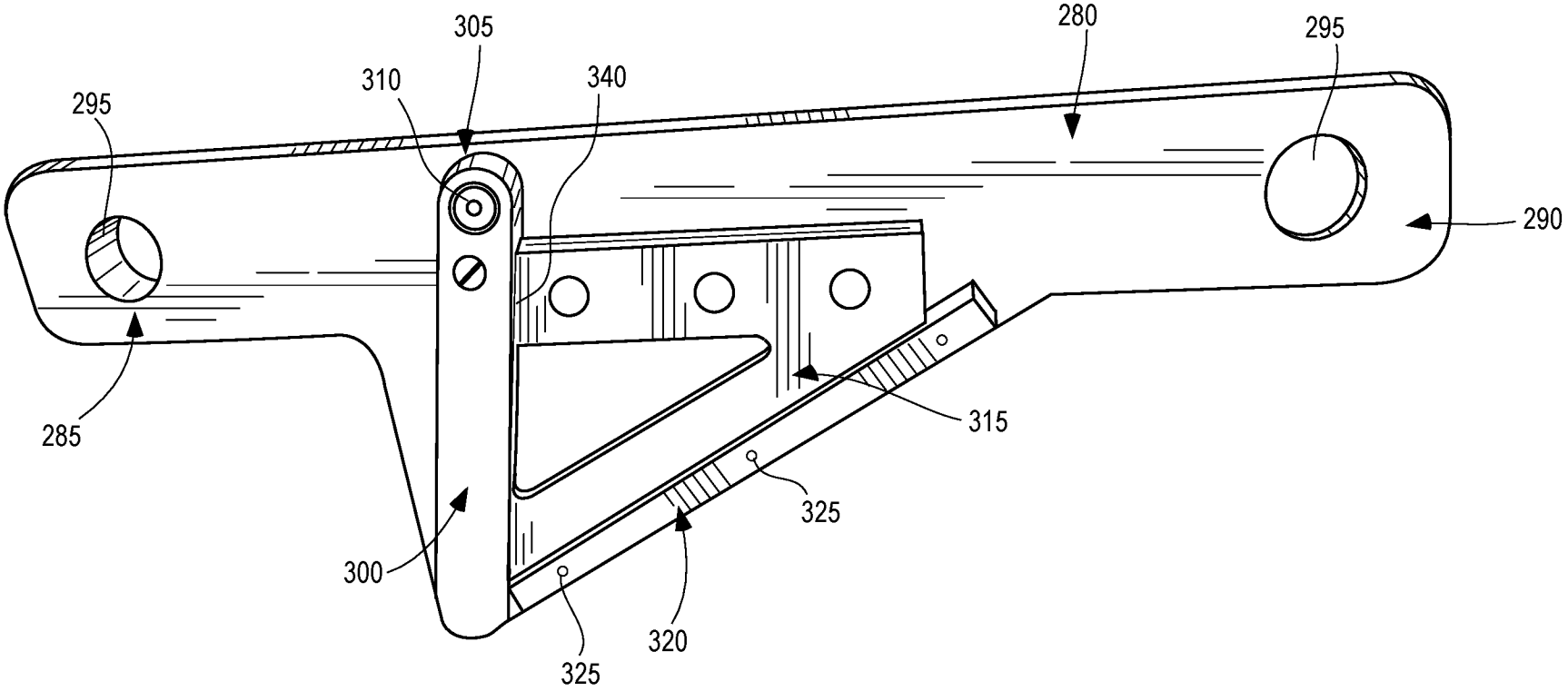
FIG. 15 is a perspective view of a second alternative embodiment of a compact portable tire rupture device, or compact rupture device, in its non-deployed configuration constructed according to the teachings of one embodiment of the present invention.
Figure 16:
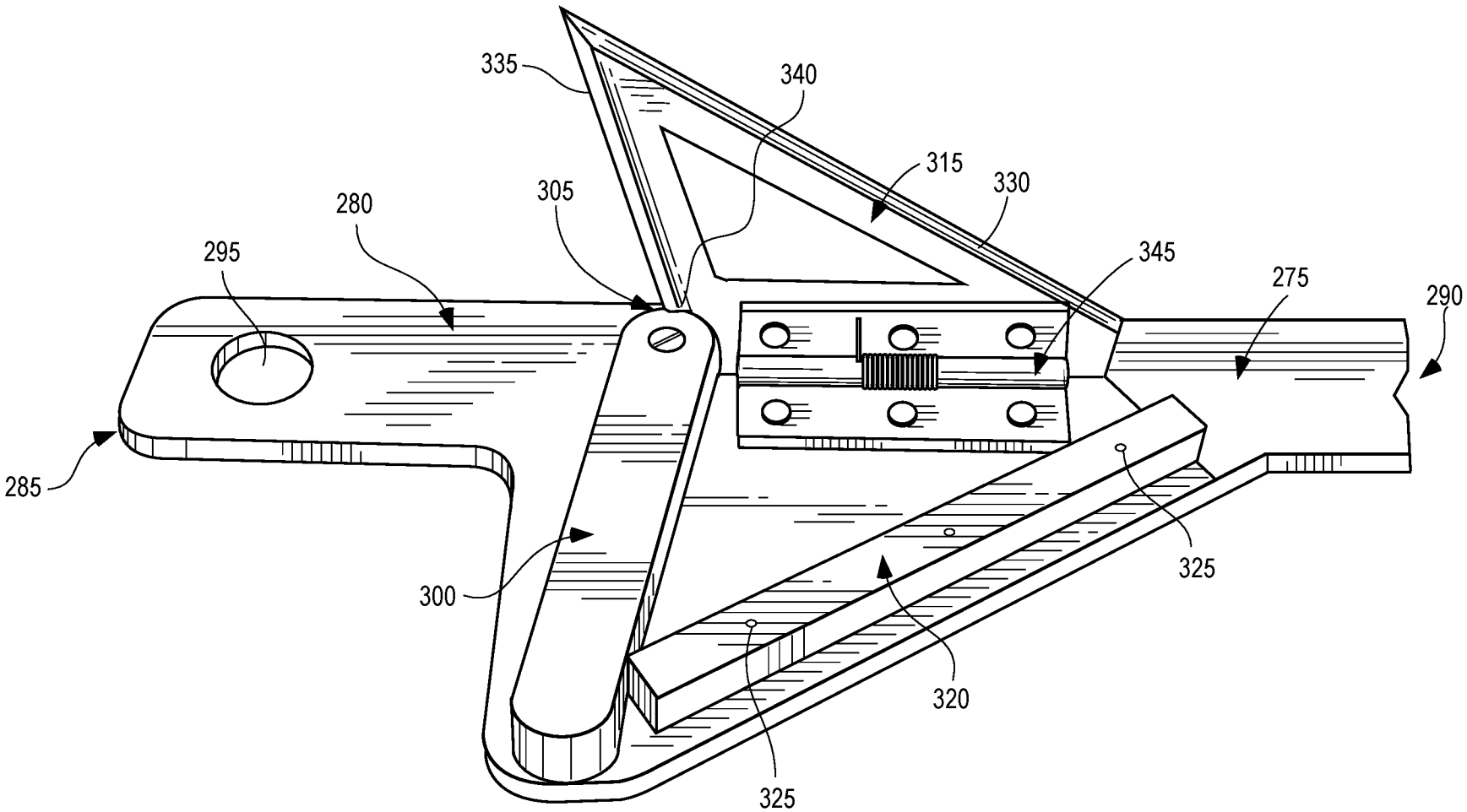
FIG. 16 is a perspective view of the compact rupture device of FIG. 15 with a guard member of the compact rupture device retaining the blade in its upright position.

An additional embodiment of a compact portable tire rupture device 275 is provided in FIGS. 15 and 16. The compact rupture device 190 is shown in FIG. 15 in its non-deployed, compact configuration. As such, in this configuration, like the rupture device 190, the rupture device 275 may be compactly stored (e.g., in a user's vehicle or backpack). Like the rupture device 190, when the rupture device 275 is deployed as described below, the rupture device 275 may be placed in front of a vehicle's tire, such as the tire 70. If a suspect tries to flee, the rupture device 275 may quickly and effectively rupture the tire to slow or prevent the suspect from fleeing the scene. The rupture device 275, like the rupture device 190 is compactly and thus comprises a few simple parts.

The rupture device 275 may be designed in a manner, and manufactured of materials, promoting a reduced weight. For example, all or at least a substantial portion of the components of the rupture device 275 may be manufactured of generally lightweight materials, such as aluminum. Additionally, various of the components (e.g., blade 315, base member 280, etc.) may include apertures, cutouts, void areas, hollow areas, thinned areas, or other areas of reduced or eliminated material in order to further promote a reduction in weight.

The rupture device 275 preferably includes a substantially flat base surface member 280, like the flat base members 15, 195. The base member 280 preferably includes each of a proximal portion 285 and a distal portion 290. At each of the proximal portion 285 and the distal portion 290, apertures 295 are preferably provided that extend through the surface of the base surface 280. The apertures 295 of the base member 280 may assist a user to easily grasp and carry the rupture device 275, especially when resting on a flat surface like a road. As above, in a preferred embodiment, the proximal portion 285 is the portion of the rupture device 275 that is placed in front of a tire such as the tire 70 when the rupture device 275 is deployed.

A lock member 300 is preferably pivotally attached to the base member 280 at a pivot point 305. The lock member 300 is preferably attached to the base member 280 by a bolt 310 in a manner substantially similar as the lock member 215 to the base member 195. The lock member 300 may help to retain a blade 315 in its collapsed position until the user is ready to deploy the rupture device 275. Like the lock member 215, the lock member 300 may include an interior (not illustrated) that is recessed so as to receive and retain a portion of the blade 315 therein. When the lock member 300 is released so that it no longer engages the blade 315, the blade 315 may be able to deploy in the manner described below.

A guard member 320 is also preferably fixedly attached to the base member 280 by bolts 325. The guard member 320 preferably is attached to the base member 280 at a specific adjacent to a first elongated exterior portion 330 (illustrated in FIG. 16) of the blade 315 when the blade 315 is retained in the rupture device 275. As such, when the rupture device 275 has yet to deploy the blade 315, as shown in FIG. 15, the blade 315 is fully enclosed by the lock member 300 and the guard member 320. In at least one embodiment, the lock member 300 and the guard member 320 abut one another prior to the blade 315 being deployed.

To deploy the blade 315, a user may pull rearwardly on the lock member 300 to release the lock member 300 from a second exterior portion 335 of the blade member 315 (illustrated in FIG. 16). The guard member 320 is shown as released from the blade member 315 in FIG. 16. FIG. 16 also illustrates a cut-out portion 340 of the blade member 315 that may be substantially similar to the cut-out portion 260 of the blade member 230. The cut-out portion 340 is preferably shaped so that when the blade 315 is deployed, the cut-out portion 340 substantially abuts and is received by the lock member 300 near its pivot point 305.

The blade member 315 is preferably attached to the base member 280 by a spring loaded hinge member 345. Thus, when the lock member 300 is rotated away from the blade member 315, the blade member 315 may spring to its upright position illustrated in FIG. 16. In its upright position, both the first exterior portion 330 and its second interior portion 335 of the blade member 315 are exposed.

After the blade member 315 has sprung into its upright position, the lock member 300 may return to the position it was in when it held the blade member 315 in place. When it does so, the lock member 300 may again abut the guard member 320. With the cut-out portion 340 abutting the lock member 300 near its pivot point 305, the blade member 315 is preferably unable to collapse.

In this configuration, the rupture device 275 may be placed in front of a tire such as tire 70. In use, the blade member 315 acts in a manner substantially similar to that of the blade member 230. When a vehicle tire such as the tire 70 runs over the blade member 315, the blade member 315 preferably quickly and efficiently ruptures the tire.

In order to collapse the blade member 315, the reverse steps of deploying the blade member 315 should be taken, as was the case for the blade member 230.

Thus, there has been shown and described a portable tire rupture device for rapidly deflating tires. As is evident from the foregoing description, certain aspects of the present inventions are not limited by the particular details of the examples illustrated herein, and it is therefore contemplated that other modifications, applications, variations, or equivalents thereof, will occur to those skilled in the art. Many such changes, modifications, variations and other uses and applications of the present constructions will, however, become apparent to those skilled in the art after considering the specification and the accompanying drawings. All such changes, modifications, variations and other uses in applications which do not depart from the spirit and scope of the present inventions are deemed to be covered by the inventions which are limited only by the claims which follow.

What is claimed is:

1. A portable rupture device for rupturing the tire of a vehicle, the portable rupture device comprising:

a base member;

a single blade hingedly attached to the base member, wherein the blade is configured to rotate about an axis horizontal to the base member and hinge longitudinally relative to the base member;

a lock member pivotly mounted to the base member; and a guard member fixedly mounted to the base member;

wherein in a first position the lock member and the guard member conceal the blade; and wherein in a second position the blade is exposed.

2. The portable rupture device according to claim 1, wherein in the first position, the lock member conceals a first external surface of the blade.

3. The portable rupture device according to claim 1, wherein in the first position, the guard member conceals a second external surface of the blade.

4. The portable rupture device according to claim 1, wherein the base member includes a distal end and a proximal end, and wherein at least one of the distal end and the proximal end includes an aperture extending through the base member.

5. The portable rupture device according to claim 1, wherein in the first position, the blade is substantially parallel to the base member.

6. The portable rupture device according to claim 1, wherein in the second position, the blade is substantially perpendicular to the base member.

7. The portable rupture device according to claim 1, wherein the blade includes a cut-out portion that engages with and abuts the lock member in the second position.

8. The portable rupture device according to claim 1, wherein the base member includes a slot in which the blade is retained.

9. The portable rupture device according to claim 1, wherein the blade is triangular in shape.

10. The portable rupture device according to claim 1, wherein an interior of the guard member is recessed to retain the blade in the first position.

* * * * *